US007391998B2

(12) United States Patent
Aoki et al.

(10) Patent No.: US 7,391,998 B2
(45) Date of Patent: Jun. 24, 2008

(54) DEVELOPING APPARATUS

(75) Inventors: Masakazu Aoki, Fukuoka (JP); Akinobu Okuda, Toyonaka (JP); Hironobu Kinoshita, Dazaifu (JP); Hideki Yasuda, Toyonaka (JP); Kazumasa Hayashi, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 220 days.

(21) Appl. No.: 11/353,077

(22) Filed: Feb. 14, 2006

(65) Prior Publication Data

US 2006/0182467 A1 Aug. 17, 2006

(30) Foreign Application Priority Data

Feb. 16, 2005 (JP) ..... 2005-038827

(51) Int. Cl.
*G03G 15/08* (2006.01)

(52) U.S. Cl. ..... 399/254; 399/256; 399/258

(58) Field of Classification Search ..... 399/254–256, 399/258, 259, 262, 263
See application file for complete search history.

(56) References Cited

U.S. PATENT DOCUMENTS

2004/0057755 A1* 3/2004 Yamaguchi et al. ..... 399/256

FOREIGN PATENT DOCUMENTS

JP 2004-117507 4/2004
JP 2004-151326 5/2004

OTHER PUBLICATIONS

English language Abstract of JP 2004-117507.
English language Abstract of JP 2004-151326.

* cited by examiner

*Primary Examiner*—Hoang Ngo
(74) *Attorney, Agent, or Firm*—Greenblum & Bernstein, P.L.C.

(57) ABSTRACT

The present invention provides a developing apparatus to be provided in a quick start up electrophotographic image forming apparatus that can efficiently prevent generation of unevenness by a screw pitch in a short period of time. The developing apparatus rotates a developer transporting screw so as to transport and supply a developer to a developer bearing member, and develops a latent image formed on an image bearing member by the developer. The developer transporting screw includes a vane winding around a rotation shaft in a spiral form. A vane surface on other side of a developer transport direction of the vane includes two planes having different angles with a rotational center line of the rotation shaft. Relationships of $\theta 2 < \theta 1$ and $10° \leqq \theta 2 \leqq 60°$ are satisfied, where $\theta 1$ denotes an angle between: the plane that has a longer distance from the rotational center line; and the rotational center line, and $\theta 2$ denotes an angle between: the face that has a shorter distance from the rotational center line; and the rotational center line.

20 Claims, 7 Drawing Sheets

DEVELOPING APPARATUS

CROSS-REFERENCE TO RELATED APPLICATIONS

The present disclosure relates to subject matter contained in priority Japanese Application No. 2005-038827, filed on Feb. 16, 2005, which is herein expressly incorporated by reference in its entirety.

BACKGROUND OF THE INVENTION

1. Field of the Invention

The present invention relates to a developing apparatus that develops a latent image formed on an image bearing member by a developer so as to convert the latent image into a visible image, a process cartridge provided with the developing apparatus, and an image forming apparatus, such as a copier and a printer, which is provided with the developing apparatus.

2. Description of Related Art

Conventionally, an electrophotographic image forming apparatus, which optically scans an original image portion that is on an outer circumferential surface of a uniformly electrified photosensitive drum (an image bearing member) so as to form an electrostatic latent image, and converts the electrostatic latent image into a visible image by using a toner that is a colored resin, is known. Such an image forming apparatus is capable of forming an image at a high speed, and thus has been used widely for digital printers, copiers and the like.

In recent years, there have been increasing demands particularly for forming color images. As electrophotographic image forming apparatuses, apparatuses for forming full color images composed of toner images of four colors: yellow (Y); magenta (M); cyan (C); and black (Bk) also have been realized. Recently, there have been increasing demands to reduce the size of the electrophotographic image forming apparatus bodies to save space, in addition to the demands for enhancing their printing speeds and image qualities.

Moreover, due to the establishment of fixing techniques by lowering melting points of toners and utilizing an induction heating method, electrophotographic image forming apparatuses that can instantly fix toners on recording sheets and can start up quickly have been developed widely.

On the other hand, a two-component developer containing a toner and a carrier has been widely used for developing electrostatic latent image to provide high image quality and low operating costs. In this case, an electrostatic latent image that is formed on a surface of the photosensitive drum is developed using a developing apparatus that is provided with a development sleeve having magnets disposed therein, by rubbing the developer against the surface of the photosensitive drum with a magnetic brush.

In such a developing apparatus, two developer transporting screws are arranged horizontally in the developing apparatus, and a developer is circulated between these two developer transporting screws, whereby the toner and the carrier can be mixed uniformly, and frictional charging of the toner can be performed sufficiently.

The sufficiently stirred developer is supplied to the development sleeve by a magnetic force of the magnets, and is transported according to rotation of the development sleeve. The transported developer passes through a developer regulating member, whereby an amount of the developer on the development sleeve is regulated to be a proper amount, and a uniform layer of the developer is formed on the development sleeve. The magnetic brush of the developer that is born by the development sleeve is in contact with the photosensitive drum that rotates at a development portion, and then the electrostatic latent image on the photosensitive drum is developed.

FIGS. 9A to 9C show a developer transporting screw for transporting a developer in the prior art, more specifically, FIG. 9A is an external perspective view of the developer transporting screw, FIG. 9B is a cross-sectional view of the developer transporting screw cut by a plane passing through a rotational center line, and FIG. 9C is a view describing a state of the developer transporting screw transporting a developer. In FIGS. 9A to 9C, reference numeral 33 denotes a rotational center line, reference numeral 34 denotes a rotation shaft, reference numeral 35 denotes a vane that winds around the rotation shaft 34 in a spiral form, and reference numeral 41 denotes a developer. Reference character θ' denotes an angle between: a vane surface on a developer transport direction side of the vane 35; and the rotational center line 33, and reference character θ denotes an angle between: a vane surface on other side of the developer transport direction of the vane 35; and the rotational center line 33. When the vane surface on the developer transport direction side of the vane 35 is closer to perpendicular with respect to the rotational center line 33 (the angle θ' is closer to 90°), the force required to transport the developer is larger, and thus the angles θ and θ' usually are set to be within a range from about 70° to about 85° (θ=θ'), considering the draft angle of a forming die and the like.

As shown in FIG. 9, in accordance with the rotation of the developer transporting screw, a developer 41 receives a pushing force in a traveling direction by the vane 35, and thus the developer 41 leans toward the vane surface on the developer transport direction side of the vane 35. Further, since the amount of the developer 41 decreases as the distance from the vane 35 increases, the developer 41 between each of the vanes 35 is transported in a state shown in FIG. 9C. Thus, from a distribution of the developer 41 in a longitudinal direction of the developer transporting screw, it is found that a part with a large amount of the developer 41 and a part with a small amount thereof are formed in accordance with a pitch of the vane 35 (hereinafter, this deviation of the developer is called a "maldistribution").

Since the developer transporting screw transports the developer 41 in the longitudinal direction by its rotation, this unevenness of the distribution of the developer 41 results in unevenness of density of an image in an oblique direction (hereinafter, this poor image is called "unevenness by the screw pitch").

Such unevenness by the screw pitch easily is generated, in particular, when using a small-sized developing apparatus for a two-component developer in which a development sleeve and a developer transporting screw for transporting a developer are arranged close to each other. In order to prevent the maldistribution of the developer in the screw vane pitch, a developer transporting screw in which an angle between: a vane surface on a developer transport direction side of a vane; and a rotational center line is set to be 60° or less (for example, see JP 2004-117507 A), and a developer transporting screw provided with a bulk-increasing vane between transporting vanes, the bulk-increasing vane having a smaller angle between: a vane surface on a developer transport direction side thereof, and a rotational center line than that of the transporting vane (for example, see JP 2004-151326 A) are suggested.

In a developing apparatus using each of the above-described developer transporting screws, the developer transporting screw rotates so that the vane surface on the developer transport direction side of the vane generates a power to push the developer in a direction perpendicular to the rotation shaft, whereby this power is utilized so as to prevent the maldistribution of the developer.

However, the configurations according to the above-described JP 2004-117507 A and JP 2004-151326 A have problems described below.

It is known that, in the case of using the usual developer transporting screw, the height of the developer 41 decreases as the distance from the vane surface on the developer transport direction side of the vane 35 increases, as shown in FIG. 9C. Thus, as described in JP 2004-117507 A, in the case where the angle between: the vane surface on the developer transport direction side of the vane; and the rotational center line is set to be 60° or less, when the developer transporting screw is in a static state, the position of the vane surface becomes lower as the distance from a tip of the vane toward a downstream side of the developer transport direction increases, and thus the maldistribution of the developer remains in a position at a long distance from the tip of the vane. In particular, in an image forming apparatus that can start up quickly, which currently is becoming popular, a quick development is necessary. However, according to the configuration of the above-described JP 2004-117507 A, a long period of time is required from the start of the rotation of the developer transporting screw to eliminating the maldistribution of the developer. As a result, if developing shortly after the start of the rotation of the developer transporting screw, the maldistribution of the developer cannot be resolved, and the unevenness by a screw pitch remains on the image.

In addition, as described in JP 2004-151326 A, in the case of providing a bulk-increasing vane having a smaller angle between: the vane surface on the developer transport direction side thereof; and the rotational center line than that of the transporting vane, when the developer transporting screw is in a static state, the maldistribution of the developer is improved due to the presence of the bulk-increasing vane. However, since such a bulk-increase is achieved at a position where the height of the bulk of the developer is not the smallest, the maldistribution of the developer remains near the vane surfaces on the other side of the developer transport direction of the transporting vanes that are long distances from the bulk-increasing vane and are adjacent to each other. Therefore, in the case of JP 2004-151326 A, similarly to the case of JP 2004-117507 A, if developing shortly after the start of the rotation of the developer transporting screw, the maldistribution of the developer cannot be resolved, and the unevenness by the screw pitch remains on the image.

The present invention is provided to address the above-described problems. The inventors of the present invention have been resolving the maldistribution of a developer near an outer circumferential part of the screw in a static state and in a rotating state, by providing an bulk-increasing portion on the vane surface on the other side of the developer transport direction of the vane of the developer transporting screw, and utilizing a bulk-increasing effect obtained thereby. However, by providing the bulk-increasing portion between the vanes that are adjacent to each other, the amount of the developer to be transported by the developer transporting screw is decreased by the thus increased bulk, and thus an image density is decreased. The inventors of the present invention have conducted a keen study by examining: an angle between the vane of the developer transporting screw and the rotational center line of the screw; and an angle between the bulk-increasing portion and the rotational center line. A result of the study, they found conditions that enable resolution of the maldistribution of a developer near the outer circumferential part of the screw in a static state and in a rotating state, and enables securing an amount of a developer to be transported.

SUMMARY OF THE INVENTION

Therefore, with the foregoing in mind, it is an object of the present invention to solve the above-described problem in the prior art, and to provide a developing apparatus to be provided in a quick start up electrophotographic image forming apparatus that can effectively prevent generation of unevenness by a screw pitch in a short period of time, and to provide a process cartridge and an image forming apparatus that are provided with the developing apparatus.

In order to attain the above-described object, a first configuration of the developing apparatus of the present invention is a developing apparatus that rotates a developer transporting screw so as to transport and supply a developer to a developer bearing member, and develops a latent image formed on an image bearing member by the developer. The developer transporting screw includes a vane winding around a rotation shaft in a spiral form. A vane surface on other side of a developer transport direction of the vane includes a plurality of faces having different angles with a rotational center line of the rotation shaft, and relationships of $\theta 2<\theta 1$ and $10° \leqq \theta 2 \leqq 60°$ are satisfied, where $\theta 1$ denotes an angle between: a face that has the longest distance from the rotational center line, among the plurality of faces; and the rotational center line, and $\theta 2$ denotes an angle between: at least one face other than the face that has the longest distance from the rotational center line, among the plurality of faces; and the rotational center line.

According to the first configuration of this developing apparatus, even when the developer transporting screw is in a static state, the developer is in a substantially horizontal state, and thus the developer supplied to the developer bearing member loses its maldistribution in a longitudinal direction in a short period of time from the start of the rotation of the developer transporting screw. As a result, the generation of the unevenness by the screw pitch can be prevented efficiently in a short period of time. In addition, by limiting the angle $\theta 2$ within the above-described range, a sufficient amount of the developer to be transported can be secured.

In addition, in the first configuration of the developing apparatus of the present invention, it is preferable that a relationship of $H2<H1\times 3/4$ is satisfied, where H1 denotes a distance, in a direction perpendicular to the rotational center line, between: a circumferential surface of the rotation shaft that is parallel to the rotational center line; and a tip of the vane, and H2 denotes a distance, in the direction perpendicular to the rotational center line, between: the circumferential surface of the rotation shaft that is parallel to the rotational center line; and a point where a face having the smallest angle with the rotational center line, among the plurality of faces, intersects a face adjacent to the face having the smallest angle with the rotational center line. According to this preferable example, since the amount of the developer that can be stored between the vanes can be increased, a decrease of an image density due to poor transporting performance of the developer can be prevented.

Moreover, in the first configuration of the developing apparatus of the present invention, it is preferable that a relationship of $L2<L1\times 3/2$ is satisfied, where L1 denotes a distance between: a point A where a vane surface on a developer transport direction side of the vane is in contact with a circumferential surface of the rotation shaft that is parallel to the rotational center line; and a point B where a face that has the shortest distance from the rotational center line, among the plurality of faces on the other side of the developer transport direction of the vane, is in contact with the circumferential surface of the rotation shaft that is parallel to the rotational center line, and L2 denotes a distance between: the point A; and a point C where a vane surface on the developer transport direction side of an adjacent vane is in contact with the circumferential surface of the rotation shaft that is parallel to the rotational center line, the adjacent vane being positioned adjacent to the vane on the other side of the developer transport direction.

Furthermore, in the first configuration of the developing apparatus of the present invention, it is preferable that a distance, in a direction perpendicular to the rotational center line, between: a circumferential surface of the rotation shaft that is parallel to the rotational center line; and the vane surface on the other side of the developer transport direction of the vane decreases, as a distance from a tip of the vane toward an upstream side of the developer transport direction increases.

Furthermore, in the first configuration of the developing apparatus of the present invention, it is preferable that an angle between: each of the plurality of faces on the other side of the developer transport direction of the vane; and the rotational center line is set to be smaller, as the face has a shorter distance from the rotation shaft. According to this preferable example, since the amount of the developer that can be stored between the vanes can be increased, a decrease of an image density due to poor transporting performance of the developer can be prevented.

Furthermore, in the first configuration of the developing apparatus of the present invention, it is preferable that at least a face on an upstream side of the developer transport direction, among the plurality of faces of the vane surface on the other side of the developer transport direction of the vane includes a curved face. According to this preferable example, since the amount of the developer that can be stored between the vanes can be increased, a decrease of an image density due to poor transporting performance of the developer can be prevented.

Furthermore, in the first configuration of the developing apparatus of the present invention, it is preferable that the rotational center line of the developer transporting screw which has the shortest distance from the developer bearing member is positioned above a rotational center line of the developer bearing member, while the developing apparatus is provided in an image forming apparatus. According to this preferable example, a pitch between the image bearing members that are adjacent to each other can be shortened, and a size of the image forming apparatus can be decreased.

Furthermore, in the first configuration of the developing apparatus of the present invention, it is preferable that a distance between: the developer transporting screw that has the shortest distance from the developer bearing member; and the developer bearing member is set to be 7 mm or less.

A second configuration of the developing apparatus of the present invention is a developing apparatus that rotates a developer transporting screw so as to transport and supply a developer to a developer bearing member, and develops a latent image formed on an image bearing member by the developer. The developer transporting screw includes: a screw body; a vane winding around the screw body in a spiral form; and a bulk-increasing portion which is provided between the vanes that are adjacent to each other, and increases a bulk of the developer existing on a downstream side of a developer transport direction among the developer existing between the vanes, and the bulk-increasing portion is structured so that a height, with respect to the screw body, of a part of the bulk-increasing portion on the downstream side of the developer transport direction may be larger than a height, with respect to the screw body, of a part of the bulk-increasing portion on an upstream side of the developer transport direction.

According to the second configuration of this developing apparatus, similarly to the first configuration of the developing apparatus of the present invention, even when the developer transporting screw is in a static state, the developer is in a substantially horizontal state, and thus the developer supplied to the developer bearing member loses its maldistribution in a longitudinal direction in a short period of time from starting of the rotation of the developer transporting screw. As a result, the generation of the unevenness by the screw pitch can be prevented efficiently in a short period of time.

In addition, in the second configuration of the developing apparatus of the present invention, it is preferable that the bulk-increasing portion is a vane surface of the vane which is provided on other side of the developer transport direction. And, in this case, it is preferable that a part of the vane surface forming the bulk-increasing portion on the most upstream side of the developer transport direction is positioned on a circumferential surface of the screw body, and a height, with respect to the screw body, of a part of the vane surface forming the bulk-increasing portion on the most downstream side of the developer transport direction is set to be smaller than ¾ times a height of a tip of the vane with respect to the screw body. Moreover, in this case, an angle between: the vane surface forming the bulk-increasing portion; and an axis line of the screw body preferably is set to be within a range from 10° to 60°.

Moreover, in the first or second configuration of the developing apparatus of the present invention, it is preferable that a two-component developer including a toner and a carrier is used as the developer.

A first configuration of the process cartridge according to the present invention is a process cartridge including: an image bearing member on which a latent image is formed; and a developing device as a processor, the process cartridge being detachable/attachable with respect to a body of an image forming apparatus. The developing device is the developing apparatus with the first configuration of the present invention.

A second configuration of the process cartridge according to the present invention is a process cartridge including: an image bearing member on which a latent image is formed; and a developing device as a processor, the process cartridge being detachable/attachable with respect to a body of an image forming apparatus. The developing device is the developing apparatus with the second configuration of the present invention.

A first configuration of the image forming apparatus according to the present invention is an image forming apparatus that forms a latent image on an image bearing member, develops the latent image by a developing apparatus, and transfers the developed image to a transfer material so as to form an image. The developing apparatus is the developing apparatus with the first configuration of the present invention.

A second configuration of the image forming apparatus according to the present invention is an image forming apparatus that forms a latent image on an image bearing member, develops the latent image by a developing apparatus, and transfers the developed image to a transfer material so as to form an image. The developing apparatus is the developing apparatus with the second configuration of the present invention.

According to the present invention, since a developer can be transported efficiently in a substantially horizontal state in a short period of time by the developer transporting screw, the developer supplied to the developer bearing member does not have a part with a large amount and a part with a small amount in the longitudinal direction. As a result, even if developing shortly after the start of the rotation of the developer transporting screw, the unevenness by the screw pitch can be prevented effectively.

These and other advantages of the present invention will become apparent to those skilled in the art upon reading and understanding the following detailed description with reference to the accompanying figures.

BRIEF DESCRIPTION OF THE DRAWINGS

The above, and other objects, features and advantages of the present invention will be made apparent from the following description of the preferred embodiments, given as non-limiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The embodiments of the present invention are explained in detail in the following in reference to the above-described drawings. FIGS. 1 through 6 illustrate a first embodiment of the present invention.

The present invention will be described more specifically below, by way of embodiments.

Embodiment 1

Figure 1A:
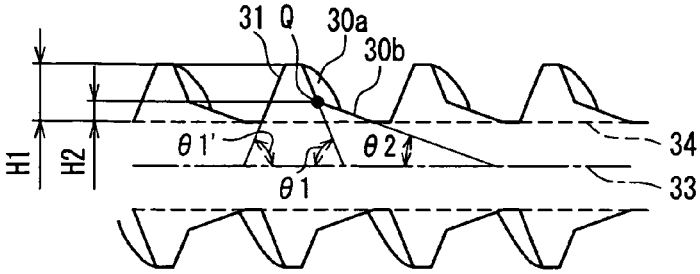
FIG. 1A is a cross-sectional view of a developer transporting screw cut by a plane passing through a rotational center line according to Embodiment 1 of the present invention.
Figure 1B:
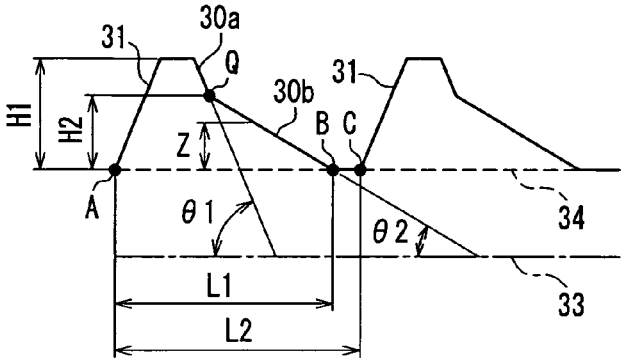
FIG. 1B is a detailed cross-sectional view of a relevant part of the developer transporting screw cut by a plane passing through the rotational center line according to Embodiment 1 of the present invention.
Figure 1C:
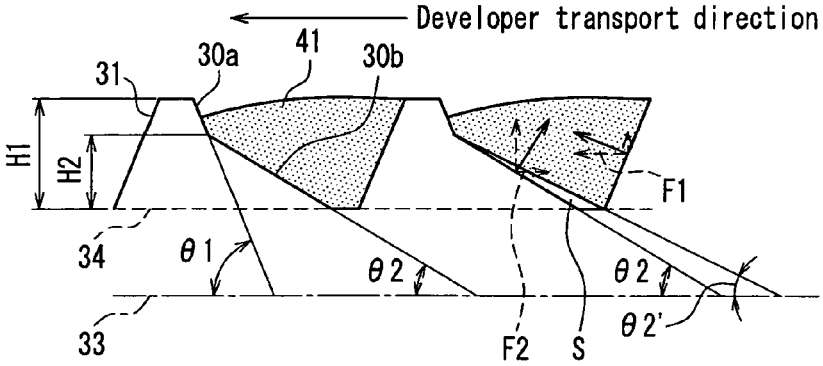
FIG. 1C is a view describing the developer transporting screw in a state of transporting a developer according to Embodiment 1 of the present invention.
Figure 1D:
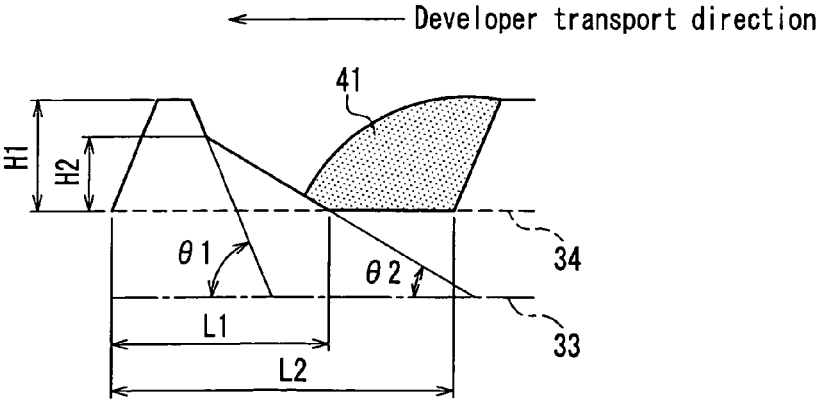
FIG. 1D is a view describing the developer transporting screw in a state of transporting a developer, in the case of increasing a distance between vanes, according to Embodiment 1 of the present invention.
Figure 2:
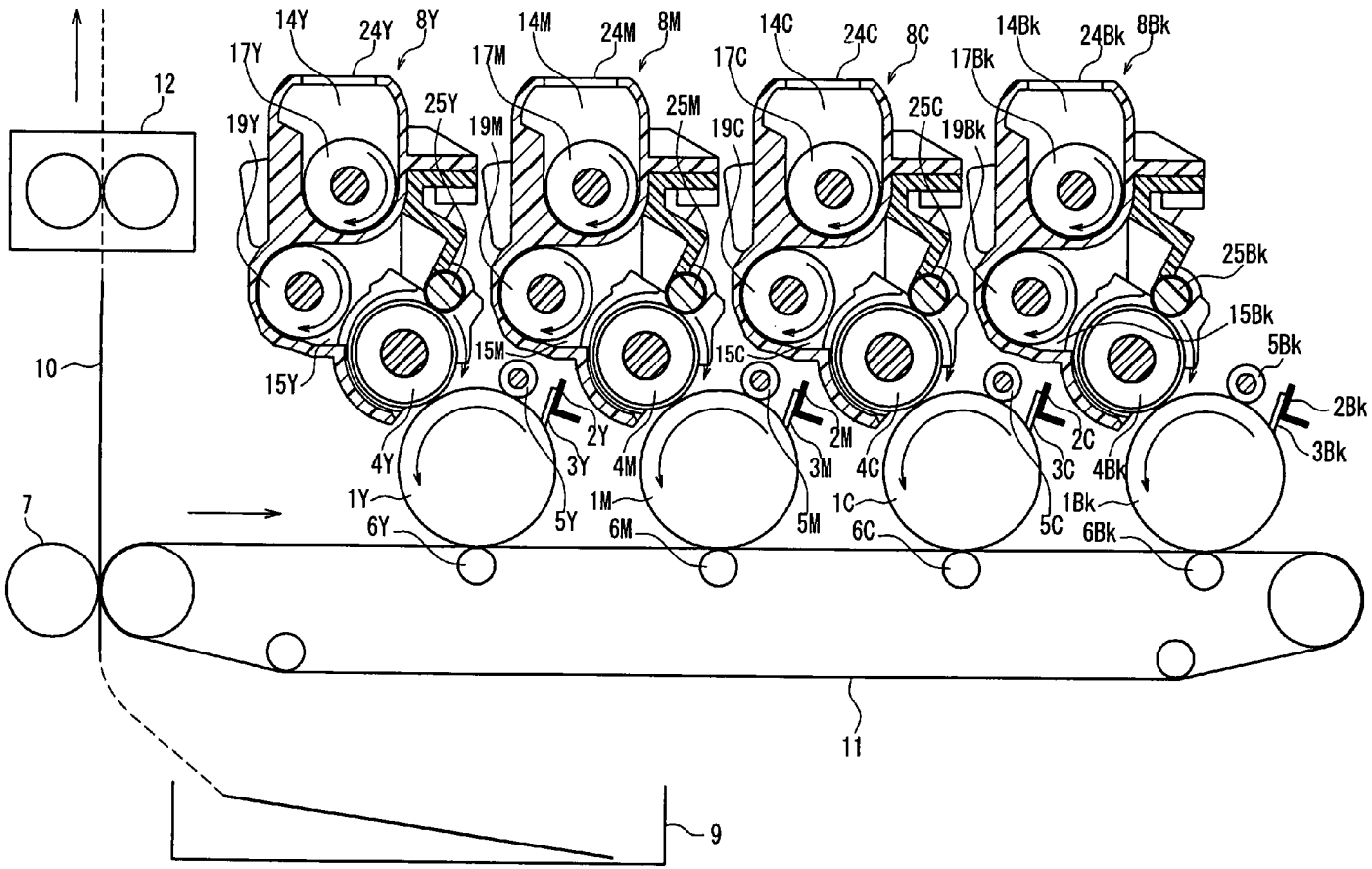
FIG. 2 is a cross-sectional view schematically showing an entire configuration of an image forming apparatus according to Embodiment 1 of the present invention.
Figure 3:
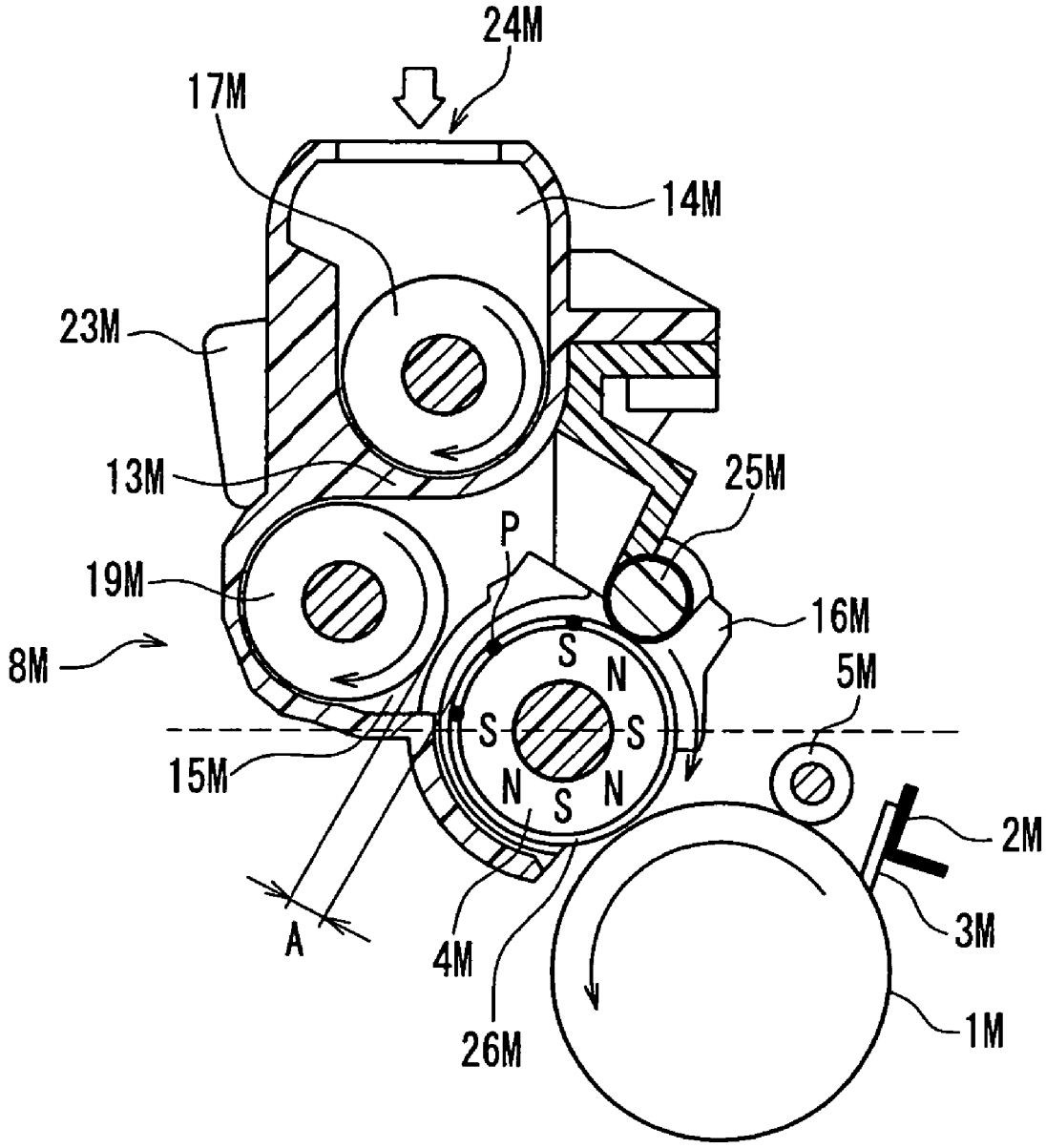
FIG. 3 is a cross-sectional view schematically showing a relevant part of an image forming unit according to Embodiment 1 of the present invention.
Figure 4:
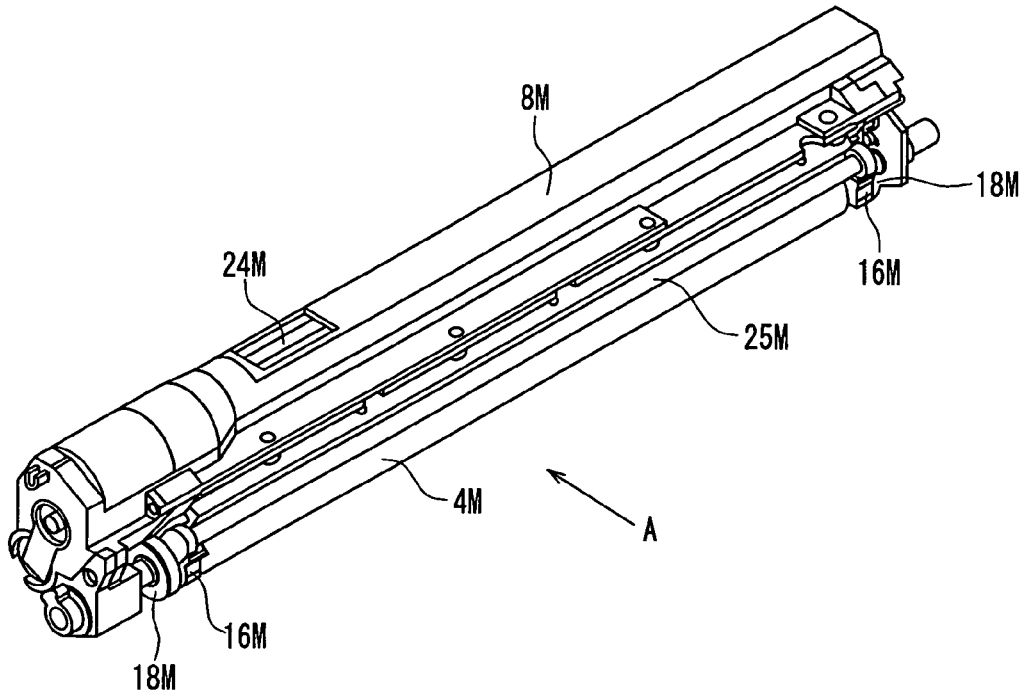
FIG. 4 is an external perspective view showing a developing apparatus according to Embodiment 1 of the present invention.
Figure 5:
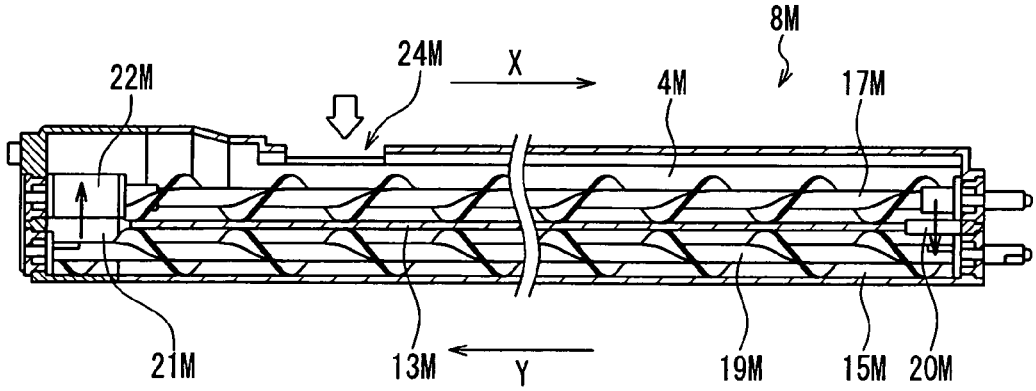
FIG. 5 is a cross-sectional view of a relevant part of the developing apparatus of FIG. 4, seen from the direction of arrow A.

FIGS. 1A to 1D show a developer transporting screw for transporting a developer in Embodiment 1 of the present invention. In particular, FIG. 1A is a cross-sectional view of the developer transporting screw cut by a plane passing through a rotational center line, FIG. 1B is a detailed cross-sectional view of a relevant part of the developer transporting screw cut by a plane passing through the rotational center line, FIG. 1C is a view describing a state of transporting a developer, and FIG. 1D is a view describing a state of transporting a developer in the case of increasing a distance between vanes. FIG. 2 is a cross-sectional view schematically showing an entire configuration of an image forming apparatus in Embodiment 1 of the present invention, FIG. 3 is a cross-sectional view schematically showing a relevant part of an image forming unit in Embodiment 1 of the present invention, FIG. 4 is an external perspective view showing a developing apparatus in Embodiment 1 of the present invention, and FIG. 5 is a cross-sectional view of a relevant part of the developing apparatus of FIG. 4, seen from the direction of arrow A.

(Entire Configuration of Image Forming Apparatus)

Firstly, an entire configuration of the image forming apparatus of the present embodiment will be described briefly, with reference to FIG. 2.

As the image forming apparatus, a commercially available laser printer (KX-CL500: manufactured by Panasonic) with a modified developing apparatus part was used. This apparatus is a four-drum type printer that exhibits a processing speed of 100 mm/s, is capable of printing about 16 recording sheets in a size of A4 per minute, and can provide a full-color print image.

As shown in FIG. 2, in the image forming apparatus of the present embodiment, four image forming units (process cartridges) that respectively are provided with the developing apparatuses and photosensitive drums as image bearing members are arranged in the order of yellow (Y), magenta (M), cyan (C) and black (Bk). Further, in the image forming apparatus of the present embodiment, between the photosensitive drum 1Y of yellow and the photosensitive drum 1M of magenta, a cleaning blade 3Y that is held by a support 2Y, and removes a toner remaining on a surface of the photosensitive drum 1Y by contacting a circumferential surface of the photosensitive drum 1Y on an upstream side is provided. In addition, a development roller 4M for allowing a toner to adhere onto the circumferential surface of the photosensitive drum 1M on a downstream side is positioned so that a shaft center thereof may be above the support 2Y, and may be positioned on a line segment connecting: the shaft center of the photosensitive drum 1Y on the upstream side; and the support 2Y Moreover, the corresponding members of the other colors are positioned similarly. According to such a configuration, a pitch between the adjacent photosensitive drums can be shorten, whereby a size of the image forming apparatus can be decreased.

A configuration of the image forming unit will be described below, using the image forming unit of magenta. Since the image forming units of the other colors have the same configuration as that of magenta, the description of the same will be omitted. The photosensitive drum 1M is a photoreceptor constructed of a suitable material such as a layered organic material, has an appropriate outer diameter such as 24 mm, and rotates at a suitable peripheral velocity such as 100 mm/s. The image forming unit is provided with: an electrifying roller 5M that electrifies the photosensitive drum 1M while rotating in accordance with the rotation of the photosensitive drum 1M; and a primary transfer roller 6M that transfers a toner image formed on the photosensitive drum 1M onto an intermediate transfer belt 11. The electrifying roller 5M is formed of a suitable material such as including an epichlorohydrin rubber around a metal shaft, and has an appropriate outer diameter thereof such as 10 mm. The primary transfer roller 6M is formed of a suitable material such as including a conductive urethane sponge around a metal shaft, and has an appropriate outer diameter thereof such as 12 mm. As the intermediate transfer belt 11, an appropriate material such as polycarbonate sheet with volume resistivity of $1\times10^9$ Ω·cm is used.

The surface of the photosensitive drum 1M that is electrified uniformly by the electrifying roller 5M is irradiated with a laser beam (not shown in the figure) according to image information, thereby forming an electrostatic latent image. And, a magnetic brush of a developer that is transported to a development region (a region between the development roller 4M and the photosensitive drum 1M) by the development roller 4M is rubbed against the electrostatic latent image, and only a toner is transferred onto the surface of the photosensitive drum 1M, thereby forming a toner image on the photosensitive drum 1M. Herein, an appropriate laser power such as 280 μW, and an appropriate DC voltage such as 1.2 kV is applied to the electrifying roller 5M. An electrification potential V0 and a potential VL after the exposure of the photosensitive drum 1M were measured, and they were −650 V and −100 V, respectively. Moreover, a bias voltage in which an AC voltage of a rectangular wave with a frequency of 3 kHz and a peak-to-peak value of 1.5 kV is superimposed with a DC voltage of −500 V is applied to the development roller 4M.

The toner image formed on the photosensitive drum 1M is transferred onto a surface of the intermediate transfer belt 11 by the primary transfer roller 6M to which a voltage of +600 V is applied.

The above-described operational processes are conducted by each of the image forming units of yellow, magenta, cyan, and black, which are provided with a developing apparatus 8Y (8M, 8C, 8Bk) and the photosensitive drum 1Y (1M, 1C, 1Bk), thereby forming a four-color synthesized toner image on the intermediate transfer belt 11. Thereafter, the synthesized toner image is collectively transferred by a secondary transfer roller 7 onto a recording sheet 10 that is transported from a recording sheet tray 9, and is fixed onto a surface of the recording sheet 10 by suitable mechanisms such as heat, pressure and the like, using a fixing device 12 provided on a path for discharging the recording sheet 10. This fixing device 12 utilizes an induction heating method, and has a property that a temperature thereof can be raised quickly. Thus, a period from a time when a user gives an instruction for printing to a time when the recording sheet 10 is output from the image forming apparatus is short. However, since the preheating time of the fixing device 12 is short, the time for stirring the developer by the developer transporting screw provided in the developing apparatus, at the time of starting up, is short accordingly.

The toner remaining on the surface of the photosensitive drum 1M after the completion of the transfer of the toner image onto the intermediate transfer belt 11 is removed by a cleaning blade 3M that is obtained by a suitable method such as by shaping an urethane rubber in a sheet, thereby completing a cycle of the image formation.

(Developing Apparatus)

The configuration of the developing apparatus of the present embodiment will be described further in detail using the developing apparatus 8M of magenta, with reference to FIGS. 2 to 5. The description below is applicable also to the developing apparatuses 8Y, 8C and 8Bk of the other colors.

As shown in FIGS. 3 and 5, the developing apparatus 8M of the present embodiment is sectionalized into two developer transport paths by a partition wall 13M. More specifically, the developing apparatus 8M includes: a first developer transport path 14M that is positioned above the partition wall 13M and at a longer distance from the development roller 4M; and a second developer transport path 15M that is positioned on below the partition wall 13M and at a shorter distance from the development roller 4M. In the first developer transport path 14M, a first developer transporting screw 17M that extends in an axial direction of the development roller 4M is provided. In the second developer transport path 15M, a second developer transporting screw 19M that similarly extends in the axial direction of the development roller 4M is provided. Moreover, a shape of a vane (a winding direction and the like) and a rotating direction of each of the first developer transporting screw 17M in the first developer transport path 14M and the second developer transporting screw 19M in the second developer transport path 15M are set, so that the first developer transporting screw 17M and the second developer transporting screw 19M, respectively, may stir and transport a developer in directions opposite to each other along the axial direction of the development roller 4M. In FIG. 5, the winding direction of the vane and the rotating direction of the first developer transporting screw 17M are set so as to stir and transport a developer in the direction of an arrow X, and the winding direction of the vane and the rotating direction of the second developer transporting screw 19M are set so as to stir and transport the developer in a direction of an arrow Y.

As shown in FIGS. 3 and 4, a projecting portion 16M projecting from a portion where the second developer transporting screw 19M is disposed toward the photosensitive drum 1M side is formed in the second developer transport path 15M, and the development roller 4M and a doctor blade 25M are held rotatably by this projecting portion 16M.

Herein, the development roller 4M has a configuration that seven magnets are arranged and fixed in a development sleeve 26M with an appropriate surface roughness such as having a surface roughness Rz of 5 μm as a developer bearing member, which is rotatable and made of a suitable material such as aluminum. These seven magnets are arranged so that a peak of the magnetic force may be formed in the development region where the development roller 4M and the photosensitive drum 1M are close to each other, and a valley of the magnetic force may be formed near the doctor blade 25M. In the present embodiment, a north pole is disposed in the development region so as to set a main pole magnetic force to be 95 mT, and the doctor blade 25M is sandwiched between a south pole and a north pole. Moreover, in a region of the development roller 4M to which the second developer transport path 15M is close, a region where a magnetic force is substantially zero (a detaching region P) is provided by arranging south poles so as to be close to each other, for the purpose of detaching the developer after the development effectively. In order to allow the magnetic force in this detaching region P to be closer to zero, a distance between the magnets with the same pole must be longer. The magnetic force in the detaching region P was measured, it was found to be a low magnetic force of 5 mT or less.

An outer diameter of the development roller 4M may be 14 mm. The development sleeve 26M including the development roller 4M rotates in a direction opposite to the rotating direction of the photosensitive drum 1M, and in a position facing the photosensitive drum 1M, it moves in the same direction as the moving direction of the photosensitive drum 1M at a peripheral velocity ratio of 1.14 with respect to the photosensitive drum 1M. The development roller 4M and the photosensitive drum 1M are arranged so as to face each other, and a gap between the development roller 4M and the photosensitive drum 1M can be adjusted by varying a diameter of gap rollers 18M that are disposed at both ends of the development roller 4M. In the present embodiment, the gap between the development roller 4M and the photosensitive drum 1M in the development region may be set to be 0.4 mm.

The doctor blade 25M regulates the amount of the developer to be transported on the development roller 4M, in accordance with the gap between the doctor blade 25M and the development roller 4M. In the present embodiment, an aluminum shaft with an outer diameter of 5 mm may be used as the doctor blade 25M.

In addition, as shown in FIG. 5, at both ends of the developing apparatus 8M in its longitudinal direction, communicating holes 20M and 21M that connect the first developer transport path 14M and the second developer transport path 15M are formed. The communicating hole 20M that is positioned at a tip portion of the first developer transporting screw 17M on a downstream side of a developer transport direction (the direction of the arrow X) is an opening with an appropriate size formed on the partition wall 13M. The developer that is stirred and transported to the communicating hole 20M by the first developer transporting screw 17M falls by the gravity, from the first developer transport path 14M into the second developer transport path 15M through the communicating hole 20M. In the present embodiment, in order to circulate the developer by a pair of the developer transporting screws well, in each of the first developer transporting screw 17M and the second developer transporting screw 19M, an outer diameter of the screw including the vane may be set to be 12 mm, a shaft diameter of a rotation shaft as a screw body may be set to be 5 mm, a screw pitch (a pitch between the vanes of the developer transporting screw in its longitudinal direction) may be set to be 25 mm, and a rotating speed may be set to be 150 rpm.

The communicating hole 21M that is positioned at a tip portion of the second developer transporting screw 19M on a downstream side of a developer transport direction (the direction of the arrow Y) also is an opening with an appropriate size formed on the partition wall 13M. Above the communicating hole 21M, a magnet roller 22M is provided. This magnet roller 22M is connected to an end of the first developer transporting screw 17M so that a shaft of the magnet roller 22M may be the same as the rotation shaft of the first developer transporting screw 17M. An outer diameter of the magnet roller 22M is substantially equal to the outer diameter of the first developer transporting screw 17M. The magnet roller 22M rotates together with the first developer transporting screw 17M in the same directions, by which the developer in the second developer transport path 15M can be brought up into the first developer transport path 14M in a form of a magnetic brush. Herein, as the magnet roller 22M of the present embodiment, a rubber magnet that may be obtained by: forming a plastic containing a ferrite powder or a magnetic powder in a roller shape; and magnetizing it to provide magnetic poles of north poles and south poles alternately at intervals of approximately 90° is used. Moreover, a magnetic members (not shown) in, for example, a SUS 400 group or the like respectively are attached to both end faces of the magnet roller 22M, thereby preventing the developer from adhering to the both end faces of the magnet roller 22M, and preventing clogging and stagnation of the developer caused thereby.

Furthermore, as shown in FIGS. 2 and 3, a shaft center (an rotational center line) of the second developer transporting screw 17M is disposed above the shaft center (the rotational center line) of the development roller 4M (the development sleeve 26M), whereby, as described above, the pitch between the adjacent photosensitive drums can be shortened, and the size of the image forming apparatus accordingly can be decreased.

Furthermore, in the present embodiment, a distance A between the second developer transporting screw 19M and the development roller 4M (see FIG. 3) may be set to be 5 mm. In addition, from experiments, it has been found that, if the distance A is larger than 7 mm, the influence of the maldistribution of the developer is small, and less unevenness by the screw pitch is generated, even in the case of using the screw of the conventional shape.

Furthermore, a scraper (a developer detaching device) that is not shown in the figure is provided close to a surface of the magnet roller 22M, on a downstream side of the rotating direction of the magnet roller 22M with respect to a position vertically above the magnetic roller 22M. The scraper is formed being combined with the first developer transport path 14M. In addition, this scraper is provided with an inclined surface that is formed inclined with respect to a direction of the rotation shaft of the first developer transporting screw 17M. Thereby, the developer that is detached from the magnet roller 22M by the inclined surface is transferred smoothly to the direction of the first developer transporting screw 17.

According to the above-described configuration, the developer is circulated between: the first developer transport path 14M that is positioned above the partition wall 13M; and the second developer transport path 15M that is positioned below the partition wall 13M.

Moreover, as shown in FIG. 3, in the first developer transport path 14M, a toner density sensor 23M that detects a toner density in the developer by a magnetic permeability of the developer is provided. Thereby, when the toner density is decreased by printing, an additional toner is replenished from a toner replenishing port 24M so as to maintain the toner density of 6%.

The developer in the second developer transport path 15M adheres onto a surface of the rotating development sleeve 26M by a magnetic field from the development roller 4M so as to form a magnetic brush, and is transported to a position where the doctor blade 25M is disposed, while rolling on the surface of the development sleeve 26M. The magnetic brush is adjusted to have a length of about 1 mm when passing in front of the doctor blade 25M, and subsequently reaches the development region. Thereafter, the toner is transferred to the photosensitive drum 1M in accordance with the electrostatic latent image formed on the photosensitive drum 1M, thereby carrying out the development. Herein, the length of the magnetic brush can be changed by adjusting a center distance between the development roller 4M and the doctor blade 25M.

The developer with the toner density decreased by the consumption of the toner for the development is transported to the detaching region P where a pair of the magnets of south poles are provided, in accordance with the rotation of the development sleeve 26M, and is released from a magnetic binding force by the development roller 4M. In addition, the developer is removed and transported by the second developer transporting screw 19M, and subsequently is adjusted to have the toner density of 6% again, while being circulated in the first developer transport path 14M and the second developer transport path 15M.

In the present embodiment, as the developer, a two-component developer containing a toner and a carrier is used. In this case, as the toner, a toner using a polyester resin as a binder resin may be used. In addition, as the binder resin, a styrene acrylic resin, an epoxy resin and the like may be used, besides a polyester resin.

As the carrier, a mixed type resin carrier containing a resin and a magnetic material may be used. Examples of the resin to be used for the mixed type resin carrier include; phenolic resins; urea resins; melamine resins; polyester resins; and epoxy resins. In particular, thermosetting resins represented by phenolic resins have durability, impact resistance, and heat resistance that are superior to those of thermoplastic resins, and thus a resin carrier containing a magnetic material and a thermosetting resin utilizing these advantages is desirable. In addition, as the carrier, for example, a carrier containing a magnetic material alone, in which a Mn-Zn ferrite with an average particle diameter of 35 μm may be used as a core material and a surface thereof further is coated with a silicone resin, may be used.

Moreover, examples of the resin for forming a coating layer on the surface of the carrier include one or more kinds of resins. More specifically, one or more kinds of resins selected from the group consisting of phenolic resins; epoxy resins; melamine resins; polyamide resins; polyester resins; styrene resins; silicone resins; fluororesins; and the like are preferable.

Moreover, a method for forming the coating layer of the resin on the surface of the carrier may be, for example, spraying the resin onto dispersed particles of a magnetic material by using a spray dryer or the like, dry-mixing the dispersed particles of the magnetic material and the resin by using a Henschel mixer, a high speed mixer or the like, or impregnating spherical composite core particles with a solvent containing the resin.

Moreover, the pigment may contain one or more kinds of pigments or dyes selected from the group consisting of black pigments such as carbon black, iron black, graphite, nigrosine and a metal complex of an azo dye; arylamide acetoacetate monoazo yellow pigments such as C.I. pigments yellow 1, 3, 74, 97 and 98; arylamide acetoacetate disazo yellow pigments such as C.I. pigments yellow 12, 13, 14 and 17; C.I. solvents yellow 19, 77 and 79; C.I. disperse yellow 164; red pigments such as C.I. pigments red 48, 49:1, 53:1, 57, 57:1, 81, 122 and 5; red dyes such as C.I. solvents red 49, 52, 58 and 8; and blue dyes or pigments including phthalocyanine and its derivative, such as C.I. pigment blue 15:3. An amount of the pigment to be added preferably ranges from 3 to 8 parts by weight with respect to 100 parts by weight of the binder resin.

Moreover, in order to electrify the toner, one or more kinds of electrification control agents may be added, if necessary. In this case, about 1 wt % to about 7 wt % of the material can be added, in accordance with whether to electrify the toner positively or negatively.

Furthermore, in order to improve the electrification of the toner or the fluidity thereof, microparticles of silica, alumina, titania and the like with an average particle diameter of 5 nm to 200 nm are added. In order to provide hydrophobicity or control the electrification, surfaces of the microparticles can be subjected to a surface treatment with a silane coupling agent, silicone oil and the like, if necessary.

Furthermore, an average particle diameter of the toner preferably ranges from 3 μm to 12 μm. If the particle diameter of the toner is too large, it is difficult to realize a high resolution. If the particle diameter of the toner is too small, the fluidity of the toner is low, and thus the mixing properties thereof with the carrier is poor.

Furthermore, as a ferromagnetic iron compound particle powder, ferromagnetic iron oxide particle powders such as magnetite and maghemite, spinel ferrite particle powders containing one or more kinds of metals except iron (e.g., Mn, Ni, Zn, Mg, Cu, etc), magnetoplumbite type ferrite particle powders such as barium ferrite, and microparticle powders of iron or iron alloys having an oxide film on surfaces thereof may be used. Among them, ferromagnetic iron oxide particle powders such as magnetite are preferably used. A particle diameter of the ferromagnetic iron compound particles preferably ranges from 0.02 μm to 5 μm. A shape thereof may be any of granular, spherical or acicular.

An amount of the magnetic material to be added in the resin preferably is 50 wt % or more, and in the resin carrier, it particularly preferably ranges from 70 wt % to 90 wt %. When the amount of the magnetic material to be added in the resin is less than 50 wt %, a magnetic force of the carrier is small, thus leading to a problem that the carrier is likely to adhere to a toner holding member.

(Shape of Screw)

A configuration of the developer transporting screw of the present embodiment will be described below, using the developer transporting screws 17M and 19M of magenta, with reference to FIGS. 1 and 5. The description below also is applicable to the developer transporting screws 17Y and 19Y (17C, 19C, 17Bk, 19Bk) of the other colors.

As shown in FIG. 5, the developer transporting screw of the present embodiment includes: a first developer transporting screw 17M in the first developer transport path 14M that is positioned above the partition wall 13M; and a second developer transporting screw 19M in the second developer transport path 15M that is positioned below the partition wall 13M. A shape of a vane (such as the winding direction) and a rotating direction of each of these developer transporting screws 17M and 19M are set, so that the developer transporting screws 17M and 19M respectively may transport a developer in directions that are opposite to each other, along the axial direction of the development roller 4M. More specifically, the winding direction of the vane and the rotating direction of the first developer transporting screw 17M are set so as to stir and transport a developer in the direction of the arrow X (the first developer transport direction), and the winding direction of the vane and the rotating direction of the second developer transporting screw 19M are set so as to stir and transport a developer in the direction of the arrow Y (the second developer transport direction). Herein, in the present embodiment, as the first developer transporting screw 17M and the second developer transporting screw 19M, screws that have: a shaft diameter of a rotation shaft of 5 mm; an outer diameter of the screw of 12 mm; the number of vane provided to the screw in a spiral form of 1; a screw pitch of 17 mm, and have different winding directions and lengths (the first developer transporting screw 17M: clockwise, 246 mm, the second developer transporting screw 19M: counter-clockwise, 265 mm) may be used. In this case, each of the first developer transporting screw 17M and the second developer transporting screw 19M is connected to a driver via a gear train that is arranged so that both of the developer transporting screws 17M and 19M can be rotated at an equal rotating speed of 151 rpm.

The conventional developer transporting screw has a configuration that a vane simply is provided winding around a rotation shaft in a spiral form so that an angle between: a vane surface on a developer transport direction side of the vane; and a rotational center line of the rotation shaft may be equal to an angle between: a vane surface on other side of the developer transport direction of the vane; and the rotational center line of the rotation shaft. Whereas, the developer transporting screw of the present embodiment further has a configuration described below, in addition to the configuration of including a vane provided winding around a rotation shaft in a spiral form. More specifically, the developer transporting screw of the present embodiment has a configuration that the vane surface on the other side of the developer transport direction of the vane 31 includes two planes 30*a* and 30*b*, as shown in FIG. 1A. Herein, the plane 30*b* functions as a bulk-increasing portion that increases the bulk of the developer 41 existing on a downstream side of the developer transport direction, among the developer 41 existing between the vanes 31 that are adjacent to each other. The relationship of $\theta 2<\theta 1$ is satisfied, where $\theta 1$ denotes an angle between: the plane 30*a* that has a longer distance from a rotational center line (an axis line) 33 of a rotation shaft 34; and the rotational center line 33, and $\theta 2$ denotes an angle between: the plane 30*b* that has a shorter distance from the rotational center line 33; and the rotational center line 33. That is, a distance Z (see FIG. 1B), in a direction perpendicular to the rotational center line 33, between: a circumferential surface of the rotation shaft 34 that is parallel to the rotational center line 33; and the vane surface on the other side of the developer transport direction of the vane 31 decreases, as a distance from a tip of the vane 31 toward the upstream side of the developer transport direction increases. Herein, an angle $\theta 1'$ between: the vane surface on the developer transport direction side of the vane 31; and the rotational center line 33 mostly is set to be equal to the angle $\theta 1$, but the effect of the present invention can be obtained even without setting the angle $\theta 1'$ to be equal to the angle $\theta 1$.

Moreover, in the present embodiment, a relationship of $L2=L1\times 1.1$ is satisfied, where, as shown in FIG. 1B, L1 denotes a distance between: a point A where the vane surface on the developer transport direction side of the vane 31 is in contact with the circumferential surface of the rotation shaft 34 that is parallel to the rotational center line 33; and a point B where, among the two planes 30*a* and 30*b* of the vane 31 that are on the other side of the developer transport direction, the plane 30*b* that has a shorter distance from the rotational center line 33 is in contact with the circumferential surface of the rotation shaft 34 that is parallel to the rotational center line 33. L2 denotes a distance between: the point A; and a point C where a vane surface on the developer transport direction side of an adjacent vane is in contact with the circumferential surface of the rotation shaft 34 that is parallel to the rotational center line 33, the adjacent vane being positioned adjacent to the vane 31 on the other side of the developer transport direction. Herein, from the experiments, it was found that, if satisfying the relationship of $L2>L1\times 3/2$ as shown in FIG. 1D, when the amount of the developer is small, a state of the transport of the developer that is transported may not be horizontal, thereby causing unevenness by the screw pitch.

Here, the state of the transport of the developer was checked, and image formation of the first sheet after turning on the power of the apparatus was tested, while varying the angle $\theta 2$ to several levels with the fixed conditions such as the outer diameters and the pitches of the first developer transporting screw 17M and the second developer transporting screw 19M. Then, results shown in Table 1 below were obtained.

TABLE 1

| | Angle θ2 (°) | | | |
|---|---|---|---|---|
| | 70 | 60 | 20 | 10 |
| Unevenness of screw pitch | D | B | A | A |
| Amount of developer to be transported | A | BC | C | C |

In Table 1 above, "A" denotes a level at which unevenness does not appear on an image at all, "B" denotes a level at which unevenness is insignificant and does not seem to be a problem, "BC" denotes the lowest acceptable level, "C" denotes a level at which improvement of unevenness is required, and "D" denotes a level at which much improvement of unevenness is required.

Figure 6:
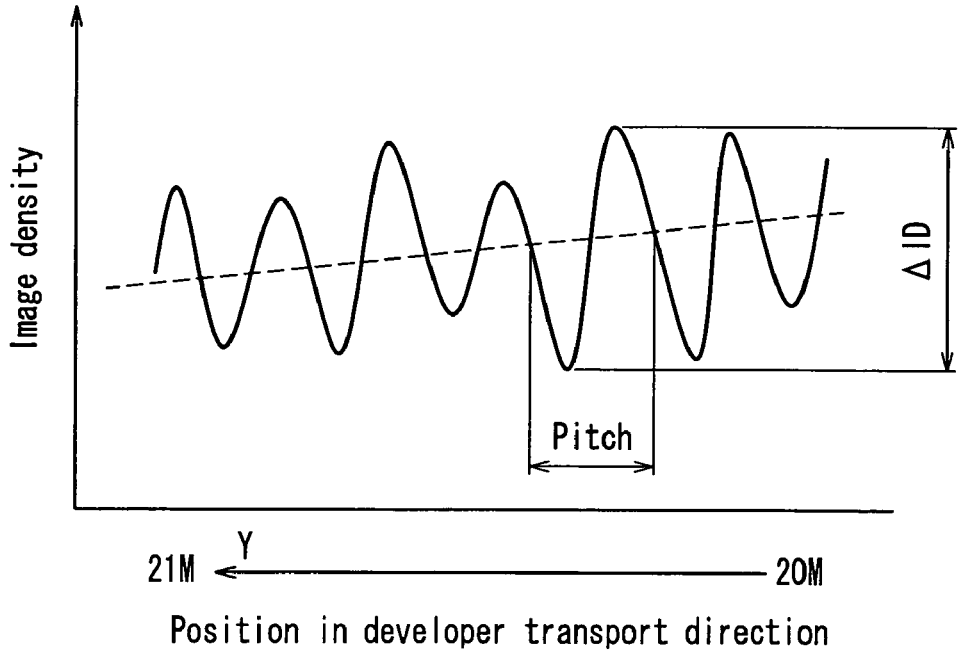
FIG. 6 is a graph showing a result obtained by measuring an image density in a developer transport direction according to Embodiment 1 of the present invention.

The above-stated levels of an image will be described below specifically, with reference to FIG. 6. FIG. 6 is a graph showing a result that was obtained by measuring an image density in the developer transport direction. As shown in FIG. 6, the image density locally fluctuates at a certain pitch in the developer transport direction (the direction of the transport of the developer transporting screw). This pitch is a distance between the vanes of the developer transporting screw that are adjacent to each other, and the local fluctuation of the image density results in the unevenness by the screw pitch. A difference between the maximum density and the minimum density (a density difference) ΔID per one pitch is measured, and when this density difference ΔID is smaller than a certain predetermined value (a predetermined density difference), the level of the image is evaluated as the acceptable level A or B. When the level of the image is evaluated as the level of BC, the density difference thereof is equal to or slightly more favorable than this predetermined density difference. In the case where the density difference ΔID is larger than the predetermined density difference, the image is evaluated as the level C at which improvement of unevenness is required or the level D at which much improvement of unevenness is required. In the case where the density difference ΔID is smaller than that evaluated as the level C at which improvement of unevenness is required, it can be improved by changing the shape of the bulk-increase of the vane surface of the vane of the developer transporting screw, on the other side of the development transport direction. At the same time, an overall image density decreases, as a distance from the communicating hole 20M increases toward the developer transport direction (the direction of the arrow Y in FIG. 5). The reason for this is because an amount of the toner in the developer is large near the communicating hole 20M in FIG. 5, whereas, near the communicating hole 21M in FIG. 5, the toner in the developer is consumed for the development as the developer is transported, and the amount of the toner in the developer accordingly decreases. In particular, in the case of outputting a solid image having 100% image coverage, the toner density in the developer decreases significantly, and thus the overall image density is likely to decrease in the developer transport direction. Herein, the amount of the developer to be transported denotes an amount of the developer that is transported by the developer transporting screw per unit time. If the toner in the developer is consumed for the development, when the amount of the developer to be transported is small, as the developer proceeds from the communicating hole 20M to the communicating hole 21M (in the direction of the arrow Y in FIG. 5), the decrease of the toner density in the developer becomes larger, and the decrease of the image density becomes larger. On the other hand, when the amount of the developer to be transported is large, as the developer proceeds from the communicating hole 20M to the communicating hole 21M (in the direction of the arrow Y in FIG. 5), the decrease of the toner density in the developer becomes smaller, and the decrease of the image density becomes smaller. Therefore, in order to prevent this decrease of the image density, the amount of the developer to be transported is needed to be a certain predetermined value (a predetermined amount) or more. At the above-described lowest acceptable level (the level BC), the amount of the developer to be transported is this predetermined amount or slightly larger than this predetermined amount. In the case where the amount of the developer to be transported is in the level C at which improvement of unevenness is required, the image can be improved by increasing a rotating speed of the development transporting screw, which can be found from the experiments. In addition, compared with the case of JP 2004-117507 A where the vane surface on the developer transport direction side of the vane includes the plurality of planes, in the case of the present embodiment where the vane surface on the other side of the developer transport direction of the vane includes the plurality of planes, a force F2 in the direction opposite to the developer transport direction is applied to the developer 41 on the vane surface on the other side of the developer transport direction of the vane 31 as shown in FIG. 1C, but since a force F1 in the developer transport direction that is applied to the developer 41 by the vane surface on the developer transport direction side is much stronger than the F2, the decrease of the amount of the developer to be transported is not a problem. Also in the case where the decrease of the amount of the developer to be transported is a problem, the amount of the developer to be transported can be increased similarly to the above, by increasing the rotating speed of the developer transporting screw.

In addition, if decreasing the angle θ2 (θ2 to θ2') as shown in FIG. 1C, the unevenness by the screw pitch can be suppressed due to the bulk-increasing effect of the developer 41, however, an area of a part represented by the reference code S is increased, and the space for the developer between vanes 31 of the developer transporting screw accordingly becomes smaller. Therefore, an amount of the developer 41 per one pitch of the developer transporting screw is decreased, and the amount of the developer to be transported accordingly is decreased. As mentioned above, the unevenness by the screw pitch has a relationship that is inversely proportional to the amount of the developer to be transported.

From the above results (Table 1), it was found that, by decreasing the angle θ2, the effect of improving the unevenness by the screw pitch can be obtained. This may be because, as shown in FIG. 1C, by gradually increasing the bulk of the developer 41 in the direction perpendicular to the rotation shaft 34, as the distance from a tip of the vane 31 of the developer transporting screw toward an upstream side of the developer transport direction increases, the state of the transport of the developer 41 transported becomes closer to horizontal.

In this case, a preferable range of the angle θ2 for obtaining the effect of improving the unevenness by the screw pitch is between 10° and 60° inclusive. It is not preferable that the angle θ2 is too small, because a force to transport the developer 41 in the transport direction is too weak, and the transporting performance of the developer 41 deteriorates, which is likely to cause a decrease in density and other properties due to the poor transport, while outputting high-density images continuously.

So far, the above description has been based on the assumption that a distance between: a point Q where the two planes 30*a* and 30*b* intersect; and the rotation shaft 34 is constant. However, by varying this distance, the height of the developer 41 in the direction perpendicular to the rotational center line 33 can be adjusted similarly. A preferable range is H2<H1×¾, where, as shown in FIG. 1A, H1 denotes a distance, in the direction perpendicular to the rotational center line 33, between: the circumferential surface of the rotation shaft 34 that is parallel to the rotational center line 33; and a tip of the vane 31, and H2 denotes a distance, in the direction perpendicular to the rotational center line 33, between: the circumferential surface of the rotation shaft 34 that is parallel to the rotational center line 33; and the point Q where the two planes 30*a* and 30*b* intersect.

If the distance H2 is set to be H1×¾ or larger, the height of the developer 41 near the vane 31 becomes significantly large, and thus a high density and an overflow of the developer from the developer transporting screw are likely to occur.

Moreover, from the results of the experiments, it was found that a preferable range of the angle θ2 is from about 10° to about 45°, within the range of H1×¼<H2<H1×¾.

In the present embodiment, the above-described results were obtained based on the assumption that the outer diameter and the pitch of the developer transporting screw are fixed, however, if the shapes thereof are changed, the preferable value of the angle θ2 is varied slightly. However, the original operational effect is not changed, where, by setting the angle θ2 to be smaller than that of the prior art, the bulk of the developer 41 existing on the downstream side of the developer transport direction is increased, and the state of transport of the developer 41 becomes close to horizontal.

Moreover, in the present embodiment, the vane 31 of the first developer transporting screw 17Y (17M, 17C, 17Bk) and the second developer transporting screw 19Y (19M, 19C, 19Bk) have the same shape, but they are not limited to this configuration. As long as the developer 41 can be circulated smoothly, another configuration is possible, in which the vane 31 of the first developer transporting screw 17Y (17M, 17C, 17Bk) has the conventional shape, and only the vane 31 of the second developer transporting screw 19Y (19M, 19C, 19Bk) has the shape described in the present embodiment. Also with this configuration, the developer 41 can be supplied to the development roller 4Y (4M, 4C, 4Bk) in a state without the maldistribution of the developer 41, thus suppressing the unevenness by the screw pitch.

As described above, according to the shape of the developer transporting screw of the present embodiment, the state of the transport of the developer 41 transported can be improved so as to be substantially horizontal, which can reduce the factors that may cause various types of unevenness of images due to the screw pitch, such as unevenness of supply of the developer 41 to the development sleeve 26Y (26M, 26C, 26Bk), unevenness of compression at the regulating portion due to the unevenness of supply, and a resultant difference in toner density between: the developer 41 transported by the developer transporting screw; and the developer 41 returned from the development sleeve 26Y (26M, 26C, 26Bk) after the development, thereby suppressing the unevenness by the screw pitch.

Embodiment 2

In the above-described Embodiment 1, the case where the vane surface on the other side of the developer transport direction of the vane includes the two planes 30*a* and 30*b* was exemplified, but the vane surface on the other side of the developer transport direction of the vane may include three planes or more, and at least one part thereof may include a curved face. In this case, as described below, the vane surface on the other side of the developer transport direction of the vane preferably has a shape projecting toward the rotational center line of the rotation shaft. A reason for this is because such a shape can correct the state of the maldistribution of the developer more precisely, and can prevent the clogging and the stagnation of the developer at a valley portion formed between: the vane surface of the vane on the developer transporting direction side; and a vane surface on the other side of the developer transport direction of an adjacent vane, the adjacent vane being positioned on the downstream side of the vane.

Figure 7:
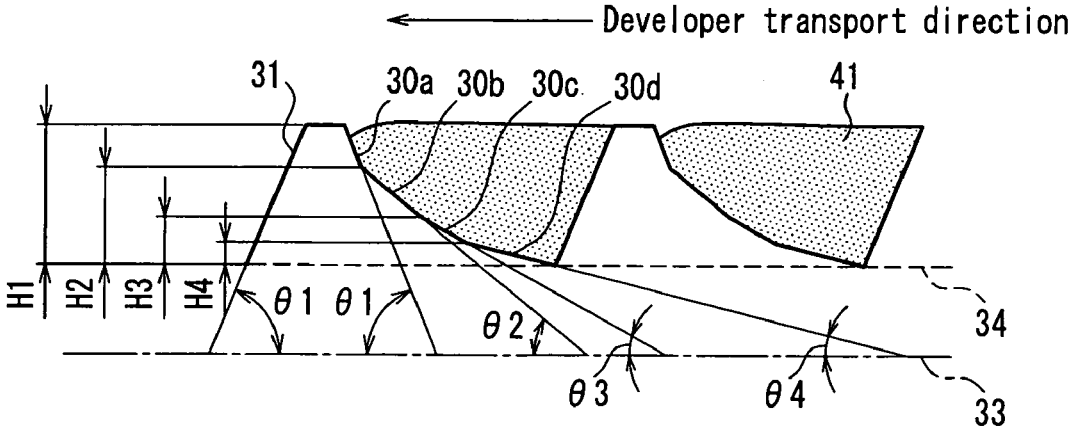
FIG. 7 is a cross-sectional view of a developer transporting screw cut by a plane passing through a rotational center line according to Embodiment 2 of the present invention.

FIG. 7 is a cross-sectional view of a developer transporting screw cut by a plane passing through a rotational center line in Embodiment 2 of the present invention.

As shown in FIG. 7, in the developer transporting screw of the present embodiment, a vane surface on other side of a developer transport direction of a vane 31 includes four planes 30*a*, 30*b*, 30*c* and 30*d*. Herein, each of the planes 30*b*, 30*c* and 30*d* functions as a bulk-increasing portion that increases the bulk of the developer 41 existing on a downstream side of the developer transport direction, among the developer 41 existing between the vanes 31 that are adjacent to each other. And, a relationship of $\theta 4<\theta 3<\theta 2<\theta 1$ is satisfied, where $\theta 1$ denotes an angle between: the plane 30*a* that has the longest distance from a rotational center line 33 of a rotation shaft 34; and the rotational center line 33, $\theta 2$ denotes an angle between: the plane 30*b* that has the second longest distance from the rotational center line 33; and the rotational center line 33, $\theta 3$ denotes an angle between: the plane 30*c* that has the third longest distance from the rotational center line 33; and the rotational center line 33, and $\theta 4$ denotes an angle between: the plane 30*d* that has the shortest distance from the rotational center line 33; and the rotational center line 33. That is, a distance, in a direction perpendicular to the rotational center line 33, between: a circumferential surface of the rotation shaft 34 that is parallel to the rotational center line 33; and the vane surface on the other side of the developer transport direction of the vane 31 decreases, as a distance from a tip of the vane 31 toward an upstream side of the developer transport direction increases. This also indicates that the vane surface including the four planes 30*a*, 30*b*, 30*c* and 30*d* has a shape projecting toward the rotational center line 33 of the rotation shaft 34.

In the developer transporting screw of the present embodiment, an outer diameter of the screw including the vane 31 may be set to be 12 mm, a shaft diameter of the rotation shaft 34 may be set to be 5 mm, the number of vane provided on the screw in a spiral form may be 1, and a screw pitch (a pitch between the vanes 31 in a longitudinal direction of the developer transporting screw) may be set to be 19 mm. Moreover, the angles $\theta 1$, $\theta 2$, $\theta 3$ and $\theta 4$ may be set to be 80°, 60°, 40° and 20°, respectively. Furthermore, the relationship of H1:H2:H3:H4=10:7:3:2 is satisfied, where H1 denotes a distance, in the direction perpendicular to the rotational center line 33, between: the circumferential surface of the rotation shaft 34 that is parallel to the rotational center line 33; and the tip of the vane 31, H2 denotes a distance, in the direction perpendicular to the rotational center line 33, between: the circumferential surface of the rotation shaft 34 that is parallel to the rotational center line 33; and a point where the two planes 30*a* and 30*b* intersect, H3 denotes a distance, in the direction perpendicular to the rotational center line 33, between: the circumferential surface of the rotation shaft 34 that is parallel to the rotational center line 33; and a point where the two planes 30*b* and 30*c* intersect, and H4 denotes a distance, in the direction perpendicular to the rotational center line 33, between: the circumferential surface of the rotation shaft 34 that is parallel to the rotational center line 33; and a point where the two planes 30*c* and 30*d* intersect.

Here, the state of the transport of the developer was checked, and image formation of the first sheet after turning on the power of the apparatus was tested, with the constant ratio of H1:H2:H3:H4 and the constant angle $\theta 3$ between the plane 30*c* and the rotational center line 33 (45°), while varying the angle $\theta 2$ between the plane 30*b* and the rotational center line 33, and the angle $\theta 4$ between the plane 30*d* and the rotational center line 33. Then, results shown in Table 2 below were obtained.

TABLE 2

| | Angle θ2 (°) | | |
|---|---|---|---|
| | 70 | 60 | 50 |
| | Angle θ4 (°) | | |
| | 30 | 20 | 10 |
| Unevenness of screw pitch | B | A | A |
| Amount of developer to be transported | A | A | A |

In Table 2 above, the signs of A and B have the same indications as those of Table 1. As is clear from the above results of Table 2, favorable results were obtained in ranges of $50° \leqq \theta 2 \leqq 70°$ and $10° \leqq \theta 4 \leqq 30°$.

In addition, even when a configuration including the outer diameter and the pitch of the developer transporting screw and an amount of the developer is changed, by optimizing the angles $\theta 1$ to $\theta 4$ and the distances H1 to H4, the state of the transport of the developer comparatively easily can be in an ideal state, that is, substantially horizontal, whereby the unevenness by the screw pitch can be prevented.

Herein, the case where the vane surface on the other side of the developer transport direction of the vane 31 includes the four planes 30*a*, 30*b*, 30*c* and 30*d* was exemplified, but the vane surface on the other side of the developer transport direction of the vane 31 may include five planes or more.

Figure 8:
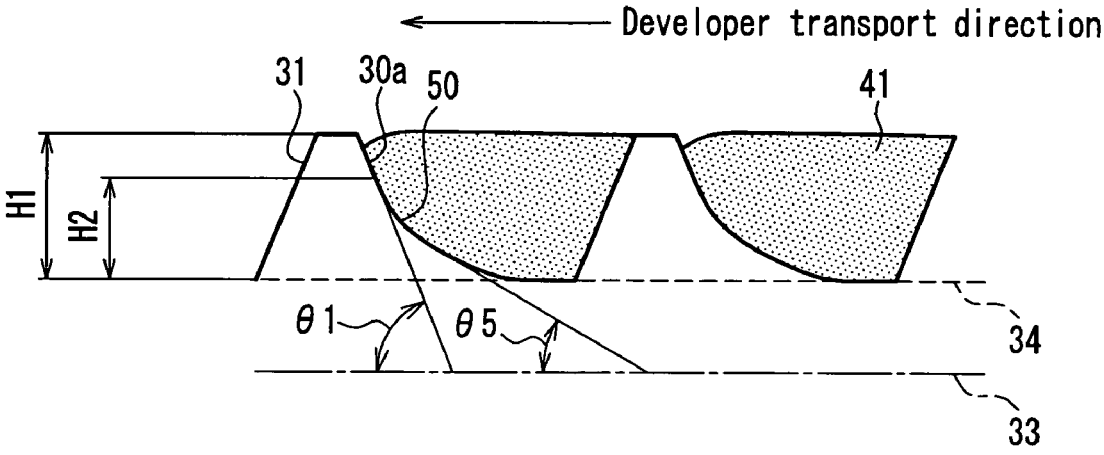
FIG. 8 is a cross-sectional view of another developer transporting screw cut by a plane passing through a rotational center line according to Embodiment 2 of the present invention.
Figure 9A:
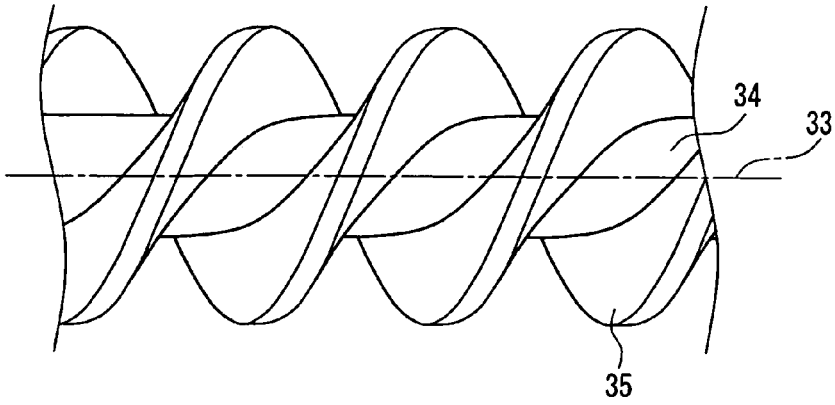
FIG. 9A PRIOR ART
FIG. 9A is an external perspective view showing a developer transporting screw in the prior art.
Figure 9B:
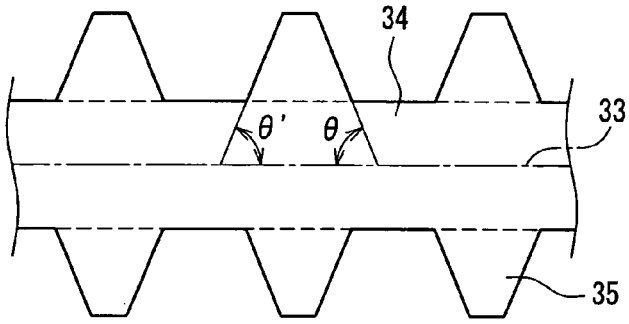
FIG. 9B PRIOR ART
FIG. 9B is a cross-sectional view of the developer transporting screw cut by a plane passing through a rotational center line in the prior art.
Figure 9C:
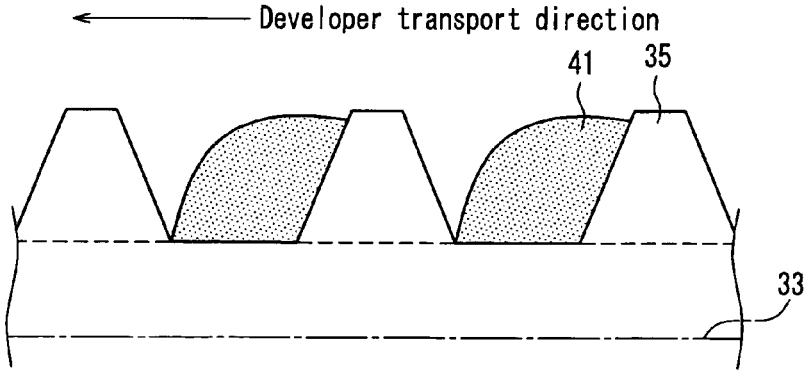
FIG. 9C PRIOR ART
FIG. 9C is a view describing the developer transporting screw in a state of transporting a developer in the prior art.

FIG. 8 is a cross-sectional view of another developer transporting screw cut by a plane passing through a rotational center line in Embodiment 2 of the present invention.

In the developer transporting screw shown in FIG. 8, a vane surface on the other side of a developer transport direction of a vane 31 includes a plane 30*a* that has a longer distance from a rotational center line 33 of a rotation shaft 34, and a curved face 50 that has a shorter distance from the rotational center line 33. Herein, the curved face 50 functions as a bulk-increasing portion that increases the bulk of the developer 41 existing on a downstream side of the developer transport direction, among the developer 41 existing between the vanes 31 that are adjacent to each other. And, the vane surface including the plane 30*a* and the curved face 50 has a shape projecting toward the rotational center line 33 of the rotation shaft 34. Moreover, relationships of $\theta 5<\theta 1$ and $10° \leqq \theta 5 \leqq 60°$ are satisfied, where θ1 denotes an angle between the plane 30*a* and the rotational center line 33, and θ5 denotes an angle between an arbitrary tangent plane of the curved face 50 and the rotational center line 33. Furthermore, a preferable range is H2<H1×¾, where H1 denotes a distance, in a direction perpendicular to the rotational center line 33, between: a circumferential surface of the rotation shaft 34 that is parallel to the rotational center line 33; and a tip of the vane 31, and H2 denotes a distance, in the direction perpendicular to the rotational center line 33, between: the circumferential surface of the rotation shaft 34 that is parallel to the rotational center line 33; and a point where the plane 30*a* and the curved face 50 intersect. Also with this configuration, the state of the transport of the developer can comparatively easily be in an ideal state, that is, substantially horizontal, whereby the unevenness by the screw pitch can be prevented.

Herein, the case where the vane surface on the other side of the developer transport direction of the vane 31 includes the plane 30*a* and the curved face 50 was exemplified, but the configuration is not limited to this. For example, the entire vane surface on the other side of the developer transport direction of the vane 31 may be a curved face, or may include: a plurality of planes having different angles with the rotational center line 33; and a curved face. That is, the vane surface on the other side of the developer transport direction of the vane 31 may have any configuration, as long as at least a part of it positioned on an upstream side of the developer transport direction is a curved face.

Moreover, the faces and the angles described above in Embodiments 1 and 2 just indicate faces that dynamically act on a developer and their angles, and do not include rounding-off of tips nor edges thereof.

The developing apparatus 8Y (8M, 8C, 8Bk) in each of the above embodiments may be structured as a developing unit that is detachable/attachable with respect to the body of the image forming apparatus, besides it may be provided in the image forming apparatus so as to be combined therewith.

Furthermore, with each of the developing apparatuses having the configurations of the above-described embodiments, the unevenness by the screw pitch can be prevented effectively, also in an image forming unit (a process cartridge) that is provided with; a photosensitive drum as an image bearing member and the developing apparatus; or a photosensitive drum, the developing apparatus; and a processor for forming an image by an electrophotographic image forming process, for example, an electrifying roller (an electrifying device), a cleaning blade (a cleaning device) or the like, and is detachable/attachable with respect to the body of the image forming apparatus.

According to the developing apparatus of the present invention, generation of unevenness by a screw pitch can be prevented efficiently in a short period of time. Thus, the developing apparatus of the present invention can be used favorably as a developing apparatus to be provided in a quick start up electrophotographic image forming apparatus, such as a copier, a facsimile, a printer and a MFP (a multifunction printer).

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A developing apparatus that rotates a developer transporting screw so as to transport and supply a developer in a developer transport direction to a developer bearing member, and develops a latent image formed on an image bearing member by the developer, wherein the developer transporting screw comprises a vane winding around a rotation shaft in a spiral form, a vane surface on a side opposite a developer transport direction side of the vane comprises a plurality of faces having different angles with a rotational center line of the rotation shaft, and relationships of $$\theta 2<\theta 1 \text{ and}$$

$$10^\circ \leqq \theta 2 \leqq 60^\circ$$

are satisfied, where

θ1 denotes an angle between: a face that has the longest distance from the rotational center line, among the plurality of faces; and the rotational center line, and θ2 denotes an angle between: at least one face other than the face that has the longest distance from the rotational center line, among the plurality of faces; and the rotational center line.

2. The developing apparatus according to claim 1, wherein a relationship of $$H2<H1\times 3/4$$

is satisfied, where

H1 denotes a distance, in a direction perpendicular to the rotational center line, between: a circumferential surface of the rotation shaft that is parallel to the rotational center line; and a tip of the vane, and H2 denotes a distance, in the direction perpendicular to the rotational center line, between: the circumferential surface of the rotation shaft that is parallel to the rotational center line; and a point where a face having the smallest angle with the rotational center line, among the plurality of faces, intersects a face adjacent to the face having the smallest angle with the rotational center line.

3. The developing apparatus according to claim 1, wherein a relationship of $$L2<L1=3/2$$

is satisfied, where

L1 denotes a distance between: a point A where a vane surface on a developer transport direction side of the vane is in contact with a circumferential surface of the rotation shaft that is parallel to the rotational center line; and a point B where a face that has the shortest distance from the rotational center line, among the plurality of faces on the other side of the developer transport direction of the vane, is in contact with the circumferential surface of the rotation shaft that is parallel to the rotational center line, and L2 denotes a distance between: the point A; and a point C where a vane surface on the developer transport direction side of an adjacent vane is in contact with the circumferential surface of the rotation shaft that is parallel to the rotational center line, the adjacent vane being positioned adjacent to the vane on the other side of the developer transport direction.

4. The developing apparatus according to claim 1, wherein a distance, in a direction perpendicular to the rotational center line, between: a circumferential surface of the rotation shaft that is parallel to the rotational center line; and the vane surface on the other side of the developer transport direction of the vane decreases, as a distance from a tip of the vane toward an upstream side of the developer transport direction increases.

5. The developing apparatus according to claim 1, wherein an angle between: each of the plurality of faces on the other side of the developer transport direction of the vane; and the rotational center line is smaller, as the face has a shorter distance from the rotation shaft.

6. The developing apparatus according to claim 1, wherein at least a face on an upstream side of the developer transport direction, among the plurality of faces of the vane surface on the other side of the developer transport direction of the vane comprises a curved face.

7. The developing apparatus according to claim 1, wherein the rotational center line of the developer transporting screw that has the shortest distance from the developer bearing member is positioned above a rotational center line of the developer bearing member, while the developing apparatus is provided in an image forming apparatus.

8. The developing apparatus according to claim 1, wherein a distance between: the developer transporting screw that has the shortest distance from the developer bearing member; and the developer bearing member is set to be 7 mm or less.

9. The developing apparatus according to claim 1, wherein a two-component developer comprising a toner and a carrier is used as the developer.

10. A developing apparatus that rotates a developer transporting screw so as to transport and supply a developer in a developer transport direction to a developer bearing member, and develops a latent image formed on an image bearing member by the developer, wherein the developer transporting screw comprises:

a screw body;

a vane winding around the screw body in a spiral form; and a bulk-increasing portion provided between the vanes that are adjacent to each other, and that increases the bulk of the developer existing on a downstream side in the developer transport direction among the developer existing between the vanes, and the bulk-increasing portion is configured so that a height, with respect to the screw body, of a part of the bulk-increasing portion on the downstream side in the developer transport direction is greater than a height, with respect to the screw body, of a part of the bulk-increasing portion on an upstream side in the developer transport direction.

11. The developing apparatus according to claim 10, wherein the bulk-increasing portion is a vane surface of the vane that is provided on other side of the developer transport direction.

12. The developing apparatus according to claim 11, wherein a part of the vane surface forming the bulk-increasing portion on the most upstream side of the developer transport direction is positioned on a circumferential surface of the screw body, and a height, with respect to the screw body, of a part of the vane surface forming the bulk-increasing portion on the most downstream side of the developer transport direction is set to be smaller than ¾ times a height of a tip of the vane with respect to the screw body.

13. The developing apparatus according to claim 11, wherein an angle between: the vane surface forming the bulk-increasing portion; and an axis line of the screw body is within a range from 10° to 60°.

14. The developing apparatus according to claim 10, wherein a two-component developer comprising a toner and a carrier is used as the developer.

15. A process cartridge comprising: an image bearing member on which a latent image is formed; and a developing device as a processor, the process cartridge being detachable/attachable with respect to a body of an image forming apparatus, wherein the developing device is the developing apparatus according to claim 1.

16. A process cartridge comprising: an image bearing member on which a latent image is formed; and a developing device as a processor, the process cartridge being detachable/attachable with respect to a body of an image forming apparatus, wherein the developing device is the developing apparatus according to claim 10.

17. An image forming apparatus that forms a latent image on an image bearing member, develops the latent image by a developing apparatus, and transfers the developed image to a transfer material so as to form an image, wherein the developing apparatus is the developing apparatus according to claim 1.

18. An image forming apparatus that forms a latent image on an image bearing member, develops the latent image by a developing apparatus, and transfers the developed image to a transfer material so as to form an image, wherein the developing apparatus is the developing apparatus according to claim 10.

19. A developer transporting screw comprising:

a vane winding around a rotation shaft in a spiral form, a vane surface on a side opposite a developer transport direction side of the vane comprising a plurality of faces having different angles with a rotational center line of the rotation shaft, and relationships of $$\theta 2<\theta 1 \text{ and}$$

$$10^\circ \leqq \theta 2 \leqq 60^\circ$$

are satisfied, where

θ1 denotes an angle between: a face that has the longest distance from the rotational center line among the plurality of faces; and the rotational center line, and θ2 denotes an angle between: at least one face other than the face that has the longest distance from the rotational center line, among the plurality of faces; and the rotational center line.

20. The developer transporting screw according to claim 19, wherein relationships of $$H2<H1\times 3/4$$

is satisfied, where

H1 denotes a distance, in a direction perpendicular to the rotational center line, between: a circumferential surface of the rotation shaft that is parallel to the rotational center line; and a tip of the vane, and H2 denotes a distance, in the direction perpendicular to the rotational center line, between: the circumferential surface of the rotation shaft that is parallel to the rotational center line; and a point where a face having the smallest angle with the rotational center line, among the plurality of faces, intersects a face adjacent to the face having the smallest angle with the rotational center line.

* * * * *